United States Patent [19]

Wroblewski

[11] 4,075,547

[45] Feb. 21, 1978

[54] VOLTAGE REGULATING TRANSFORMER

[75] Inventor: Theodore Wroblewski, Danvers, Mass.

[73] Assignee: Frequency Technology, Inc., Littleton, Mass.

[21] Appl. No.: 598,270

[22] Filed: July 23, 1975

[51] Int. Cl.[2] ..... G05F 3/06

[52] U.S. Cl. ..... 323/60; 336/178; 336/184; 336/212

[58] Field of Search ..... 323/6, 48, 56, 60, 61; 336/165, 178, 184, 212

[56] References Cited

U.S. PATENT DOCUMENTS

| | | | |
|---|---|---|---|
| 1,654,097 | 12/1927 | Shackelton | 336/165 X |
| 2,446,033 | 7/1948 | Wellings | 336/184 X |
| 2,694,177 | 11/1954 | Sola | 323/60 |
| 2,706,271 | 4/1955 | Fletcher | 323/60 X |
| 3,204,210 | 8/1965 | Duenke | 336/165 |
| 3,360,753 | 12/1967 | Wroblewski | 336/178 X |

*Primary Examiner*—A. D. Pellinen

*Attorney, Agent, or Firm*—Cesari and McKenna

[57] ABSTRACT

A ferro-resonant, voltage-regulating transformer. The transformer has a primary winding formed about a portion of each leg in each of two spaced, juxtaposed cores. A regulated output voltage is produced at a resonant circuit formed by a capacitor and a secondary winding around another leg of the first core. The flux variations in the two cores are continuously out of phase with each other. As the primary voltage changes the magnitude of the total flux in the system, the flux in the second core can vary in magnitude and phase thereby to maintain the flux in the first core at a constant level. Thus, the output voltage at the resonant circuit is substantially constant.

2 Claims, 6 Drawing Figures

VOLTAGE REGULATING TRANSFORMER

BACKGROUND OF THE INVENTION

This invention relates generally to voltage-regulating transformers and more specifically to voltage-regulating transformers of the ferro-resonant type.

Voltage-regulating ferro-resonant transformers are well known. These transformers comprise a primary winding, a tuned secondary circuit including the secondary winding, and an electromagnetic shunt. The output of the tuned secondary circuit is essentially constant. Within a normal range of input voltages, the secondary circuit resonates and drives the core into saturation. The flux produced by the primary voltage appears in the core or is switched through the shunt. Thus, the secondary voltage remains substantially constant notwithstanding changes in the input voltage.

Such prior voltage regulating transformers are bulky. Furthermore, magnetic circuits in which flux transfers between a closed core and an abutting or integral shunt are characterized by eddy current losses which reduce the overall transformer efficiency.

Therefore, it is an object of this invention to provide a compact ferro-resonant voltage regulating transformer.

It is a further object of the invention to increase the efficiency of a ferro-resonant voltage regulating transformer.

Yet another object of this invention is to provide a voltage regulating transformer with improved regulation.

SUMMARY OF THE INVENTION

In accordance with my invention, a ferro-resonant voltage-regulating transformer has a closed or partially closed first core and, a second core which has an air gap and is spaced from the first core. A primary winding around two juxtaposed legs of the first and second cores receives an unregulated input voltage and induces a magnetic flux in both cores. A secondary circuit, including a tuned secondary winding on the first core, produces the regulated output voltage.

The primary voltage induces a flux in the closed first core which increases until that core is driven into saturation through the operation of the tuned secondary winding. After the first core saturates the flux in the second core increases greatly, since the flux in that core is the difference between the total flux produced by the primary winding and the flux in the first core. Therefore, the secondary output voltage tends to remain constant even though the input voltage varies.

This invention is pointed out with particularity in the appended claims. The above and further objects and advantages of this invention may be better understood by referring to the following description taken in conjunction with the accompanying drawings.

DESCRIPTION OF AN ILLUSTRATIVE EMBODIMENT

Figure 1:
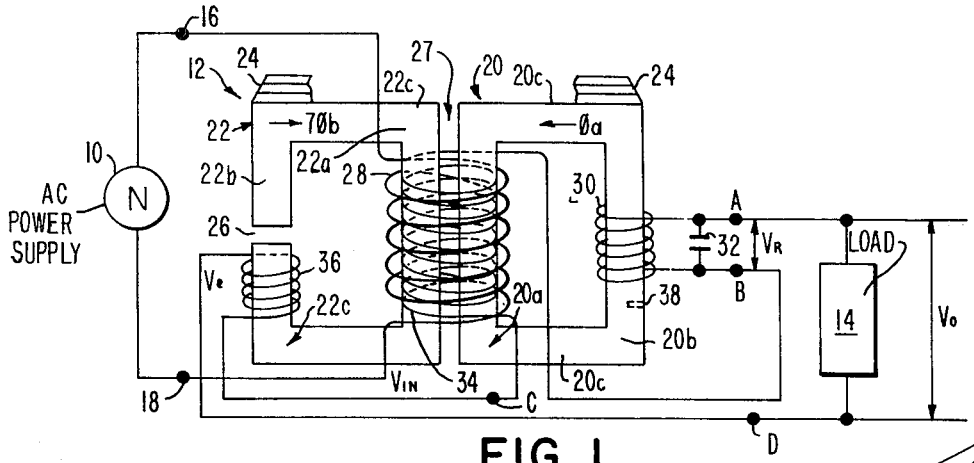
FIG. 1 is a schematic diagram of a voltage regulating transformer constructed in accordance with my invention.

FIG. 1 depicts a regulating transformer 12 connected to receive an unregulated voltage from an ac power source 10 and energizes an electrical load 14. Typically, the voltage from the power source 10 is subject to variations of ±15%.

In FIG. 1, the source 10 connects to input terminals 16 and 18 for the regulating transformer 12. The transformer 12 comprises laminated magnetic cores 20 and 22, each of which comprises a plurality of magnetically permeable laminations 24. The core 20 constitutes a closed magnetic circuit having vertical legs **20*a* and 20*b* connected by horizontal legs 20*c*. Core 22 comprises horizontal legs 22*c*, a vertical leg 22*a* close to but spaced from the leg 20*a* and another vertical leg 22*b* which includes an air gap 26. Legs 20*a* and 22*a* are separated by an air gap 27**.

In this embodiment, a primary winding 28, wraps around core legs **20*a* and 22*a*. A secondary winding 30, on the leg 20*b*, is connected in parallel with a capacitor 32** to form a resonant circuit.

A voltage $V_{in}$ applied to terminals 16 and 18 induces a flux $\phi_{in}$ in cores 20 and 22. The flux $\phi_{in}$ has components $\phi_a$ in core 20 and $\phi_b$ in core 22.

The voltage $V_R$ across the winding 30 is a function of the saturation flux of core 20, $\phi_{as}$, the frequency, F, of the input voltage and the number of turns, N of winding 30, i.e., to a rough approximation:

$$V_R = 4N\phi_{as}F.$$

$V_R$ provides a regulated output voltage at terminals A and B of transformer 12.

The reluctance of the magnetic circuit comprising core 22 and gap 26 is considerably higher than the reluctance of the closed magnetic circuit 20. Thus, as $\phi_{in}$ changes, $\phi_a$ tends to lead $\phi_b$ in time. After core 20 saturates, however, flux $\phi_b$ accounts for substantially all further increases in $\phi_{in}$. Since $\phi_{in} = \phi_a + \phi_b$, $\phi_b$ varies in amplitude and phase with relation to $\phi_a$ so as to assist in maintaining the magnitude of $\phi_a$ constant with variations in $\phi_{in}$.

Within normal primary voltage variations, only core 20 saturates. Core 22 functions as a reactance in series with transformer core 20, which reactance increases as the input voltage increases. This core normally operates at substantially less than its saturation level and consequently there is less total loss in the system over a range of varying load conditions than in prior voltage regulating transformers wherein the entire core structure saturates.

Figure 2A:
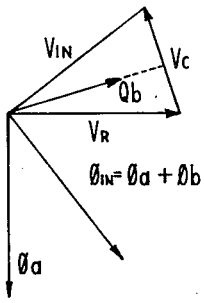
FIGS. 2A and 2B are vector diagrams showing the amplitude and phase relationships of the voltages and magnetic flux in the transformer.
Figure 2B:
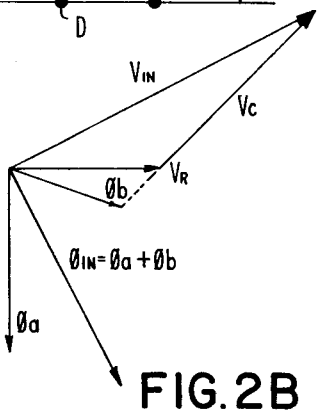

FIGS. 2A and 2B show the amplitude and phase relationships of various voltages and fluxes in core 12 of FIG. 1. FIG. 2A shows $V_{in}$ at its normal line level and the resultant flux $\phi_{in}$. $\phi_{in}$ comprises, in part, $\phi_a$ which induces voltage $V_R$. FIG. 2B shows $V_{in}$ increased to the high line condition and $\phi_{in}$ correspondingly increased. $\phi_a$ and $V_R$ remain constant for the reasons noted above and $\phi_b$ is shown to vary in phase and amplitude from FIG. 2A so that:

$$\phi_{in} = \phi_a + \phi_b.$$

The core 20 may include a partial gap, as shown at 38 in leg 20b, so as to decrease the saturation flux of this core.

In another embodiment of the invention also shown in FIG. 1, a direct-coupling secondary winding 34 is arranged around core legs 20a and 22c, e.g. around primary winding 28. A voltage $V_{in}$, induced in winding 34, is proportional to $V_{in}$. The windings 30 and 34 are connected in series to form a partially regulated output voltage between terminals A and C. If $V_{in}'$ is less than $V_{in}'$, the output voltage ($V_{in}' + v_R$) varies less than $V_{in}$ and thus this circuit provides a degree of regulation of $V_{in}$ which is adequate for many purposes. The use of the direct-coupling winding 34 is desirable since it reduces the proportion of the load power which is regulated by the transformer 12 and thereby reduces the losses in the core structure.

In another embodiment of the invention, shown in FIG. 1, a correction winding 36 is arranged around leg 22b. A voltage $V_C$ is induced in winding 36 by flux $\phi_b$. Windings 30, 34 and 36 are connected in series to produce an output voltage $V_o$ between terminals A and D. In this embodiment the capacitor 32 is across only a portion of the output voltage and can, therefore, have a lower voltage rating.

Since $V_R$ is essentially constant, winding 36 can be arranged so that ($V_{in}' - V_C$) is constant thereby eliminating the voltage variations in $V_{in}'$. Actually, $V_R$ increases somewhat with $V_{in}$ and I therefore prefer to arrange the winding 36 to make changes sufficiently to compensate for changes in $V_R$ as well as $V_{in}'$. More specifically, winding 36 has a sufficient number of turns with respect to windings 30 and 34 so that $V_C$ compensates for changes in $V_R$ and $V_{in}'$.

Figure 3A:
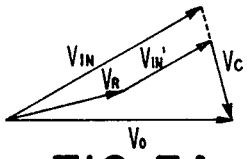
FIGS. 3A and 3B are vector diagrams showing the components of the regulated output voltage.

FIG. 3A is a vector diagram of Vin', $V_R$, $V'_{in}$, $V_C$ and $V_o$ for normal line voltage. The diagram expresses the vector relation:

$$V_R + V_{in}' + V_C = V_o.$$

Figure 3B:
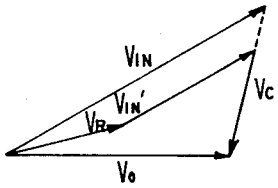

FIG. 3B is a vector diagram showing the same quantities as FIG. 3A with $V_{in}$ in a high voltage condition and $V_{in}'$ increased proportionately. $V_c$ has varied in amplitude and phase so that $V_o$ remains essentially constant.

Since the cores 20 and 22 are magnetically independent the winding 28 shown in FIG. 1 may comprise two series windings, one on the leg 20a and the other on the leg 22a. The input voltage $V_{in}$ is distributed between the windings so that the $\phi_a$ and $\phi_b$ vary as described above.

Figure 4:
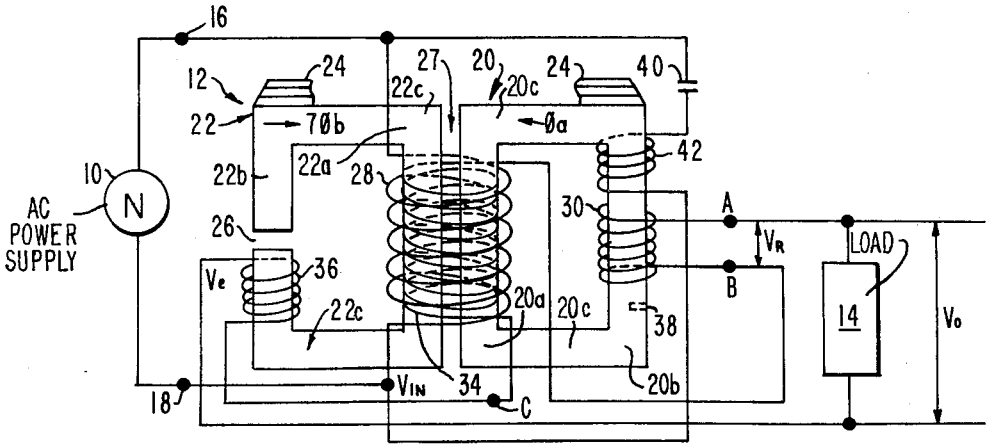
FIG. 4 is a schematic diagram of another embodiment of the presently described voltage regulating transformer.

The value of the resonating capacitor can be reduced by using the arrangement shown in FIG. 4. As shown therein, a capacitor 40 which replaces the capacitor 32 of FIG. 1, is connected to terminal 16 of the transformer 12 and in series with a secondary winding 42 around core leg 20b. The other terminals of winding 42 is connected to transformer terminal 18. The circuit comprising capacitor 40 and winding 42 functions in a similar manner to the circuit comprising winding 30 and capacitor 32 of FIG. 1. That is it regulates the flux $\phi_a$, and thereby keeps the voltage across winding 30 essentially constant.

This embodiment offers a further improvement in that current from capacitor 40 is now discharged through the primary coil 28 thereby imparting a power factor correction to the winding 28 and improving the efficiency of the transformer 12.

The voltage regulating transformer 12 described herein (FIG. 4) may, by way of example, be constructed in the following configuration:

| | |
|---|---|
| Winding 28 | 54 turns |
| Winding 30 | 37 turns |
| Winding 34 | 35 turns |
| Winding 36 | 50 turns |
| Winding 40 | 360 turns |
| Capacitor 40 | 28 uF, 660 volts |
| Gap 26 | .25 inches |
| Gap 27 | .040 inches |
| Gap 38 | .010 inches |
| Core legs 20A and 22A Combimned cross section | 3.0" × 3.5" |
| Core legs 20B, 20C, 22A, 22B, 22C Cross section | 1.5" × 3.5" |
| Overall dimensions of transformer 12 | 10.75"W × 7.0"D × 9.0"H |

From the foregoing it can be seen that the above objects of the invention have been substantially accomplished.

Wherefore I claim:

1. A ferro-resonant voltage regulating transformer, comprising:

A. first and second permeable magnetic cores, said cores spaced by an air gap and said first core comprising a closed magnetic circuit, said second core having an air gap, B. a primary winding for connection to a source of alternating current of fluctuating voltage, said primary winding arranged around a portion of both said cores for inducing a magnetic flux therein, C. a resonant secondary winding having first and second terminals, said resonant secondary winding being arranged around a portion of said first core, so that a voltage is induced in said resonant winding in response to the magnetic flux in said first core, D. a capacitor in parallel with said resonant winding, said resonant winding and said capacitor forming a resonant circuit which resists voltage increases across said resonant winding beyond a preselected level and thereby substantially limits the maximum instantaneous magnetic flux in said first core over a range of primary voltage variations to regulate the voltage across the resonant circuit, whereby a substantial flux flows in said second core when the flux in said first core increases beyond the preselected level.

E. a direct transfer winding arranged around said primary winding, said primary winding inducing a voltage in said direct transfer winding proportional to the primary voltage, F. a secondary correction winding around a portion of said second core, said correction winding being connected in series with said resonant winding and said direct transfer secondary winding so that the regulated output voltage is the sum of the voltages across said resonant winding, said direct transfer secondary winding and the correction winding, and whereby the flux in said second core induces a voltage in said correction winding to compensate for fluctuations in the voltage across said direct transfer winding.

2. A voltage regulating transformer as defined in claim 1 further comprising a gap partially through said first core for decreasing the saturation flux of that core.

* * * * *